United States Patent [19]

Johnson, Jr. et al.

[11] 4,000,829

[45] Jan. 4, 1977

[54] CONTAINER CLOSURE UNIT

[75] Inventors: Arthur L. Johnson, Jr., Rockford; Marlow W. Dodge, Loves Park, both of Ill.

[73] Assignee: Johnson Enterprises, Inc., Rockford, Ill.

[22] Filed: Aug. 16, 1973

[21] Appl. No.: 388,982

[52] U.S. Cl. ..... 220/265; 220/367; 215/247

[51] Int. Cl.[2] ..... B65D 41/20; B65D 51/16

[58] Field of Search ..... 220/27, 51, 85 F, 89 A, 220/265, 367; 215/247; 206/247

[56] References Cited

UNITED STATES PATENTS

| | | | |
|---|---|---|---|
| 2,190,054 | 2/1940 | Cutter et al. | 220/27 |
| 2,804,224 | 8/1957 | Barton | 215/247 |
| 3,343,699 | 9/1967 | Nicko | 215/247 |
| 3,509,879 | 5/1970 | Bathish et al. | 220/27 X |

*Primary Examiner*—William Price
*Assistant Examiner*—Steven M. Pollard
*Attorney, Agent, or Firm*—Leydig, Voit, Osann, Mayer & Holt, Ltd.

[57] ABSTRACT

The closure is an improvement over that shown in our U.S. Pat. No. 3,592,351 in that the present closure is capable of accommodating a tap with non-coaxial gas and draw tubes which make the tap effective for use in series tapping systems.

1 Claim, 5 Drawing Figures

CONTAINER CLOSURE UNIT

BACKGROUND OF THE INVENTION

This invention relates to a closure unit for sealing a container such as a barrel of draft beer. More particularly, the invention relates to a closure of the same general type as shown in our U.S. Pat. No. 3,592,351; such a closure serving to seal a relatively large opening through which the barrel may be cleaned, filled and tapped.

SUMMARY OF THE INVENTION

The general aim of the present invention is to provide a new and improved closure unit which possesses most of the advantages of our previously patented closure while better lending itself to use with barrels which are connected into a series tapping system.

A related object is to provide a unique closure unit capable of accommodating a tap having two radially spaced and non-coaxial tubes which enable the tap to be used effectively in a series tapping system.

In a more detailed sense, the invention resides in the provision of a closure unit in which a pair of tube-receiving plugs are uniquely incorporated into a main closure which seals off the opening in the barrel.

These and other objects and advantages of the invention will become more apparent from the following detailed description when taken in conjunction with the accompanying drawings.

DETAILED DESCRIPTION OF THE PREFERRED EMBODIMENT

Figure 2:
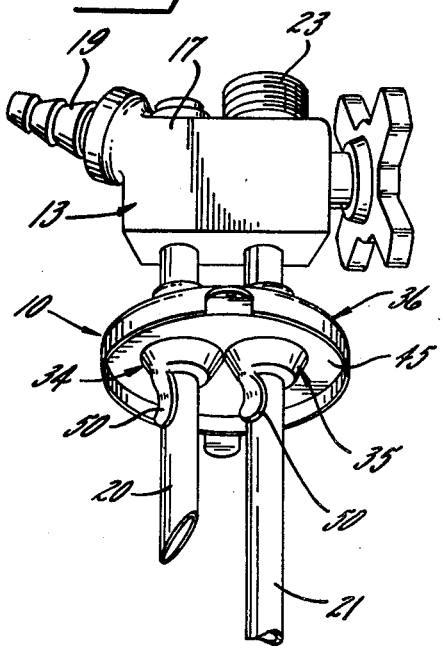
FIG. 2 is a fragmentary perspective view showing an exemplary tap in conjunction with the closure unit.
Figure 5:
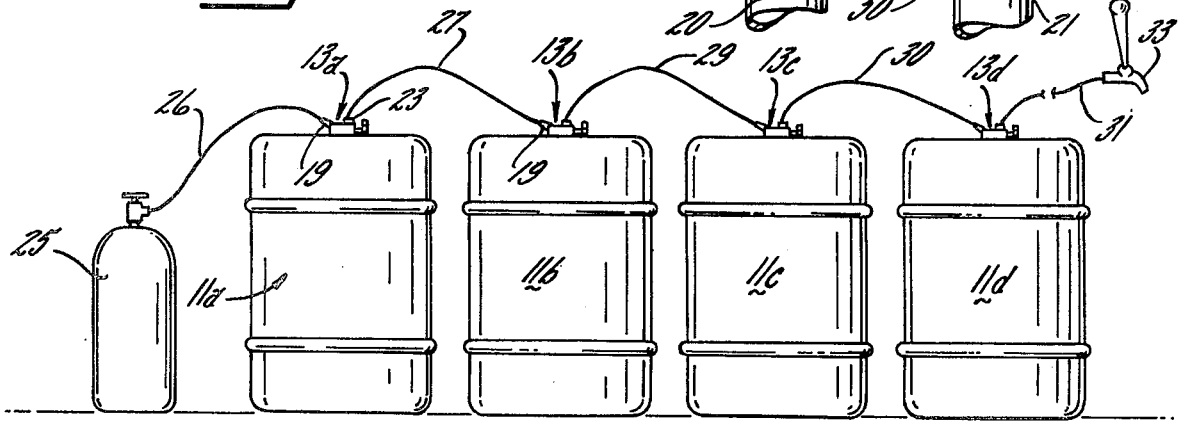
FIG. 5 is a schematic view showing a series tapping system.

As shown in the drawings for purposes of illustration, the invention is embodied in a closure 10 for a container 11 (FIGS. 3 and 5) for holding pressurized fluids such as charged beverages, chemicals and the like which are adapted to be withdrawn from the container through a dispensing device 13 (FIG. 2). Herein, the container is illustrated as being a barrel of draft beer having a top formed with a neck 14 defining an opening 15 (FIG. 3) communicating with the interior of the barrel, the neck being encircled by a peripheral flange or lip 16. The hole 15 is the only hole in the barrel 11 and is sufficiently large (e.g., approximately two inches in diameter) to facilitate rapid and convenient filling and cleaning of the barrel.

The dispensing device 13 is a tapping assembly having a block-like head 17 (FIG. 2). Pressurized air or carbon dioxide from a hand pump or a gas cylinder is admitted into the barrel 11 through a line (not shown) connected to a gas nipple 19 which is attached to the head 17 and which communicates with a relatively short gas tube 20 depending from the head and extending into the barrel. To withdraw the beer, a comparatively long draw tube 21 is fastened to the head and extends downwardly to the bottom of the barrel. As the pressurized gas is admitted into the barrel through the gas tube, the beer is forced upwardly through the draw tube and into a dispensing line (not shown) which is coupled to a fitting 23 attached to the head.

In many bars and taverns, it is the practice to connect several barrels of beer together in a so-called series tapping system. In such a system, several barrels **11*a*, 11*b*, 11*c*, 11*d*, etc. (FIG. 5) are placed side-by-side in a storage area and each is tapped with one of the taps 13. A cylinder 25 of carbon dioxide is connected to the gas nipple 19 of the first tap 13*a* by a line 26, and the beer fitting 23 of such tap is connected to the gas nipple of the next adjacent tap 13*b* by a line 27. Similar lines 29 and 30 connect the beer fittings 23 of the taps 13*b* and 13*c* to the gas nipples 19 of taps 13*c* and 13*d*, respectively. Finally, a beer dispensing line 31 is connected to the beer fitting 23 of the tap 13*d* and leads to the dispensing faucet 33** in the bar area.

With the barrels 11 thus connected in series, beer flows out of the draw tube 21 of the tap **13*d* and into the dispensing line 31 when the bartender draws a beer from the faucet 33. At the same time, the barrel 11*d* is replenished by beer flowing out of the draw tube 21 of the tap 13*c*, through the line 30, and into the barrel 11*d* through the gas tube 21 of the tap 13*d*. In a like manner, the barrel 11*c* is replenished by beer from the barrel 11*b* while the barrel 11*b* is replenished with beer from the barrel 11*a*, the beer being forced from barrel to barrel by the pressurized gas cylinder 25 connected to the gas fitting 19 of the tap 13*a*. Accordingly, the barrel 11*a* is depleted first and the barrels 11*b*, 11*c* and 11*d*** are depleted in succession. Such a series system is advantageous in that it permits several barrels to be tapped simultaneously so that the bartender need not tap a new barrel each time one barrel is emptied.

In the tap disclosed in our aforementioned patent, the gas tube is telescoped over and is coaxial with the draw tube. While such a tap is quite satisfactory for use with a single barrel, some difficulty is encountered when it is used in a series tapping system. That is, the annular flow passage which is defined between the outer side of the draw tube and the inner side of the coaxial gas tube is of relatively small area. Although this annular passage is sufficiently large to conduct gas into the barrel when the tap is used with a single barrel, the relatively small area of the passage creates a restriction which impedes the flow of beer when beer is introduced into the barrel through the gas tube as is the case in a series system.

The present invention provides a tap 13 which overcomes the disadvantage of our previous tap and further provides a novel sealing unit or closure 10 which can be used equally well with either the tap 13 or with our previous tap. As shown, the gas tube 20 and the draw tube 21 of the tap 13 are not coaxial but instead are spaced radially from one another and are arranged in non-telescoping relation. As a result, the flow passage through the gas tube 20 is not restricted by the draw tube 21 and thus beer may flow freely into the gas tube when the tap is used in a series system. The closure unit 10 is uniquely constructed with a pair of sealing plugs 34 and 35 which receive the spaced tubes 20 and 21, respectively, and either plug can be used to receive the coaxial tubes of our previous tap.

Figure 3:
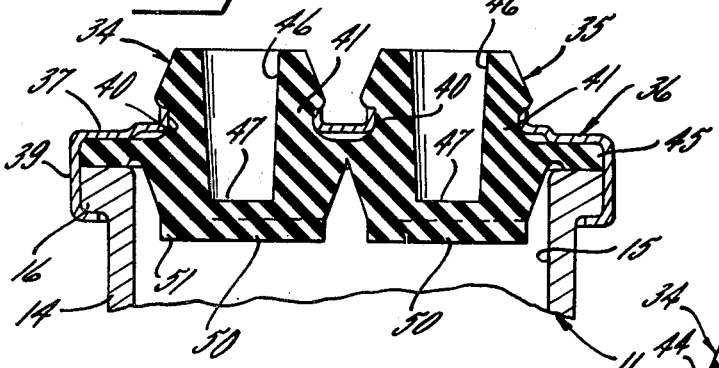
FIG. 3 is an enlarged fragmentary cross-section taken substantially along the line 3—3 of FIG. 1.

More specifically, the closure unit 10 includes a main closure member which herein is in the form of an overcap 36 adapted to remain on the barrel 11 from the time the barrel is filled and leaves the brewery until the time that it is returned empty for cleaning and refilling. The overcap 36 is formed from a relatively thin piece of yieldable sheet metal and includes a circular top plate 37 (FIG. 3) approximately the same diameter as the lip 16 surrounding the neck 14 on the barrel. Depending from and extending around the top plate is a peripheral skirt 39 which is sufficiently long that the free edge of the skirt projects below the underside of the lip when the overcap is initially telescoped over the neck. The skirt is straight as initially formed and then is hooked inwardly beneath the lip as shown in FIG. 3 by a suitable crimping tool after the barrel has been cleaned and filled and the overcap has been telescoped over the neck. As a result of such hooking, the overcap is locked securely in place on the barrel.

The sealing plugs 34 and 35 coact with the overcap 36 to close the opening 15 and serve to keep the barrel 11 sealed until the latter is tapped. In addition, the sealing plugs accommodate admission of the gas and draw tubes 20 and 21 into the barrel and also seal around the tubes to prevent the beer from escaping upwardly along the outer sides of the tubes during such times as the tubes are in the barrel.

Figure 1:
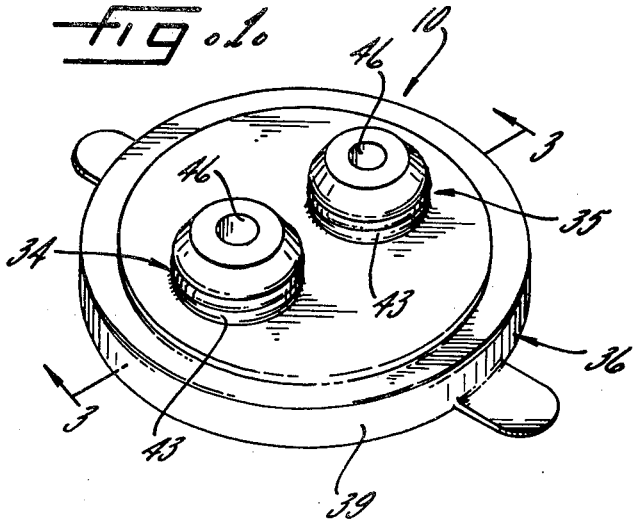
FIG. 1 is a perspective view of a new and improved closure unit embodying the novel features of the present invention.

As shown in FIG. 3, the sealing plugs 34 and 35 are received within two spaced holes 40 formed through the top plate 37 of the overcap 36, the axes of the holes intersecting a common diameter of the cap. Each sealing plug comprises a generally cylindrical body 41 (FIG. 3) made of resiliently yieldable material such as rubber and press fitted into the respective hole 40. Preferably, the relaxed diameter of each body 41 is slightly larger than the diameter of the hole 40 so that the rubber becomes compressed as an incident to being telescoped into the hole and thereafter expands into tight sealing engagement with the edges of the hole to establish a seal between the overcap 36 and the sealing plug. Such seal is effectually improved by bending the portions of the top plate 37 surrounding each hole upwardly from the plane of the plate thereby to form an annular collar 43 (FIG. 1) of substantial axial length snugly engaging a corresponding length of the plug. The upper end portion of each plug is formed with an upwardly sloping taper to facilitate insertion of the plug into the hole from the lower side of the top plate, the base or major diameter of the taper being larger than the body portion 41 thereby to define a downwardly facing shoulder 44 (FIG. 4) which engages the upwardly facing raw edge of the collar 43 to prevent the plug from inadvertently being forced downwardly through the hole 40.

Advantageously, the sealing plugs 34 and 35 are connected by and are both molded integrally with an enlarged washer 45 (FIGS. 2 and 3) which is used to establish a tight seal between the overcap 36 and the barrel 11. As shown in FIG. 3, the washer 45 is formed intermediate the ends of the plugs and extends radially outwardly therefrom to the inner periphery of the skirt 39. The washer is disposed face-to-face against the underside of the top plate 37, and the outer edge portions of the washer are sandwiched between the top plate and the upper side of the lip 16 thereby forming a gasket which becomes compressed against the lip when the skirt is crimped beneath the lip.

In order to permit insertion of the gas tube 20 and the draw tube 21 into the barrel 11 as an incident to tapping the barrel, each sealing plug 34, 35 is formed with an axially extending bore 46 (FIGS. 1 and 3) which is just slightly larger in diameter than the tubes. As shown most clearly in FIG. 3, a thin rubber membrane 47 is molded integrally with each plug and extends across the lower end of the bore 46 to seal the latter. The membranes are sufficiently strong to withstand the pressure within the barrel and to keep the bores sealed until the barrel is tapped, but are sufficiently thin to be punctured by the lower pointed ends of the tubes 20 and 21 when the tubes are forced downwardly into the bores. Thus, with downward telescoping of the tubes into the bores as an incident to tapping the barrel, the membranes become punctured, and the torn edges thereof fold downwardly around the tubes and form sealing lips 49 (FIG. 4) which resiliently grip the tubes and automatically establish a seal between the tubes and the plugs 34 and 35 to prevent the charged beer from spewing out through the bores 46. The sealing lips 47 grip the tubes sufficiently tight to hold the tap 13 in place and thus it is not necessary to otherwise attach the tap to the closure unit 10 or the barrel 11.

Figure 4:
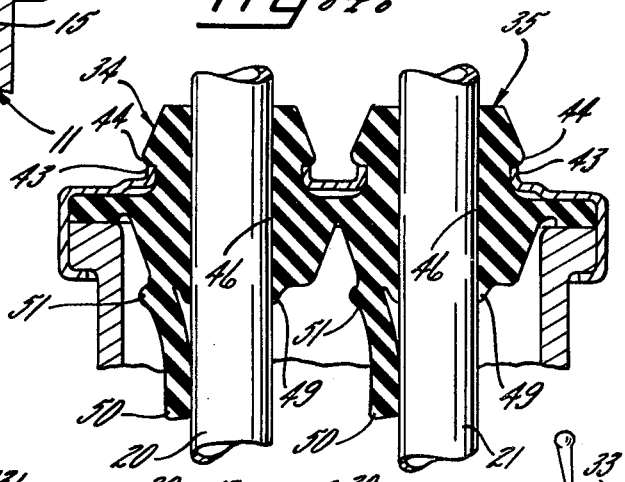
FIG. 4 is a view similar to FIG. 3 but showing the closure unit in conjunction with the tap.

Preferably, a flapper 50 (FIGS. 2 and 4) is molded integrally with the lower end of each plug 34, 35 and is mounted to swing relative to the plug about a hinge 51 formed by a short segment of rubber connecting the flapper to the lower end of the plug. Normally, the flappers are urged into face-to-face sealing engagement with the lower sides of the membranes 47 by virtue of the pressure of the beer within the barrel 11. The flappers thus serve as auxiliary seals preventing escape of the beer through the bores 46 in case the membranes should be punctured accidentally during shipment of the barrel. When the barrel is tapped, the lower ends of the tubes 20 and 21, after puncturing the membranes, engage the flappers and swing the latter downwardly about the hinges as shown in FIG. 4 thus enabling admission of the tubes into the barrel. After the barrel has been emptied and after the tubes have been pulled out of the bores 46 in the plugs, the flappers are forced upwardly about the hinges and back into engagement with the membranes and the lower ends of the plugs by the pressure of the beer remaining in the bottom of the barrel. The flappers therefore close off the punctures formed through the membranes and maintain the barrel in a sealed condition during its return to the brewery. This insures that the barrel will not become contaminated by water, dirt or the like during its return.

From the foregoing, it will be apparent that the present invention brings to the art a new and improved closure unit 10 which includes many of the same advantages as the closure described in the aforementioned patent and which is particularly adapted for use with a tap 13 having non-coaxial tubes 20 and 21 to facilitate series tapping. The tap and closure unit also may be used advantageously in a gravity feed system in which the barrel is inverted and the beer is dispensed by gravity rather than pressurized gas. In such an instance, the beer flows freely out of the unrestricted gas tube while the draw tube serves as a vent to admit air into the upper portion of the barrel.

Of course, it should be appreciated that use of the closure unit 10 and the tap 11 is not restricted to a series or gravity feed system since the tap may be used in a conventional manner when tapping a single barrel. Because of the tightness with which the two annular sealing lips 49 grip the two radially spaced tubes 20 and 21, it is not necessary to provide any other attaching connecting between the tap and the barrel even when the tap is used in conjunction with a hand pump and is subjected to the manual forces applied during operation of the pump. The closure unit also may be used with taps having coaxial tubes and, in such an instance, both tubes are simply telescoped into the bore 46 in one of the plugs 34 or 35 in the manner described in the aforementioned patent. Thus, those establishments having a supply of coaxial tube taps may use the same to tap barrels equipped with the closure units 10 of the present invention.

We claim as our invention:

1. A unit for sealing a beverage container having an upwardly projecting neck defining an opening through which a beverage may be introduced into the container and into which the beverage and gas tubes of a tapping device may be inserted for purposes of dispensing the beverage from the container, said unit comprising an overcap having a circular top plate and having a peripheral skirt depending from said top plate, said skirt being of sufficient diameter to telescope over said neck and being sufficiently flexible to be crimped into engagement with the neck to establish a fluid-tight seal between the overcap and the container, first and second diametrically spaced holes formed through said top plate, first and second sealing plugs formed integrally with one another and each having an upper end portion telescoped snugly into and projecting upwardly from the respective hole, each of said plugs having a lower end portion extending below said top plate, an enlarged washer formed integrally with both of said plugs intermediate the ends of the plugs, said washer being disposed face-to-face with the underside of said top plate and being adapted to seat against the neck to help establish the seal between the container and the overcap, the lower plug portions below said washer being spaced from one another and being spaced inwardly from the wall of said opening, first and second axially extending bores formed in said first and second plugs, respectively, and of sufficient diameter to permit insertion of the tubes into the container through the bores, membranes of resiliently yieldable material extending between the walls of said bores to seal off the latter and being sufficiently thin to be punctured by the tubes as an incident to insertion of the tubes through said bores, and first and second swingable flappers formed integrally with the lower end portions of said plugs and pivotally joined to the latter along first and second hinges disposed radially outwardly of the respective bores.

* * * * *